US005240506A

United States Patent [19]

Liers et al.

[11] Patent Number: 5,240,506

[45] Date of Patent: Aug. 31, 1993

[54] PROCESS FOR THE ULTRASONIC CLEANING OF A PRINTING CYLINDER

[75] Inventors: Arthur H. Liers, Smithtown; Louis J. Principe, Deer Park; Nikita Zekulin, Locust Valley; Asgaralt Hosein, Far Rockaway, all of N.Y.

[73] Assignee: Sonicor Instrument Corporation, Copiague, N.Y.

[21] Appl. No.: 781,699

[22] Filed: Oct. 21, 1991

Related U.S. Application Data

[63] Continuation of Ser. No. 328,953, Mar. 27, 1989, Pat. No. 5,058,611.

[51] Int. Cl.[5] ..... B08B 3/10

[52] U.S. Cl. ..... 134/1; 134/19; 134/33

[58] Field of Search ..... 134/1, 33, 19

[56] References Cited

U.S. PATENT DOCUMENTS

| | | | |
|---|---|---|---|
| 4,178,188 | 12/1979 | Dussault et al. | 134/33 |
| 4,372,787 | 2/1983 | Fields et al. | 134/1 |
| 4,561,902 | 12/1985 | Lee | 134/1 |

OTHER PUBLICATIONS

Invoice for Sonicor Ultrasonic Cleaning System CU-9616 HTFR-43, dated Mar. 30, 1988.

Invoice for Sonicor Ultrasonic Cleaning Console CU-9310A, dated Dec. 3, 1986.

Invoice for Sonicor Ultrasonic Cleaning System CU-9810A, dated Dec. 4, 1986.

Invoice for Sonicor Ultrasonic Cleaning System UC-10314 HFTLL-43, dated Nov. 5, 1987.

Invoice for Sonicor Ultrasonic Cleaning System CU-9610 HTFR, dated Aug. 14, 1987.

Invoice for Sonicor Ultrasonic Cleaning System CU-4804 HTFR, dated Feb. 11, 1988.

*American Printer*, p. 153, Jun. 1987.

*Packaging Printing & Converting*, p. 74, Dec. 1988.

*Gravure Association of America*. Mar. 28, 1988.

*Primary Examiner*—Theodore Morris

*Assistant Examiner*—Zeinab El-Arini

*Attorney, Agent, or Firm*—Collard & Roe

[57] ABSTRACT

An process and apparatus for carrying out the ultrasonic cleaning of a printing cylinder including a cleaning tank, which contains a liquid cleaning detergent into which the printing cylinder to be cleaned is immersed. Heaters are also included for heating and maintaining the temperature of the cleaning liquid at a temperature below 185° F., preferably within the range of 130°-160° F. while the printing cylinder is cleaned. The cleaning of the printing cylinder within the cleaning tank of the apparatus is carried out by ultrasonic waves which are generated and radiated throughout the cleaning liquid for a period of time, generally, between 5-30 minutes. In a preferred embodiment of the apparatus and process, the printing cylinder is continually rotated within the cleaning tank during the period of time when the ultrasonic waves are radiating through the cleaning liquid.

15 Claims, 3 Drawing Sheets

PROCESS FOR THE ULTRASONIC CLEANING OF A PRINTING CYLINDER

This is a continuation of copending application Ser. No. 07/328,953 filed on Mar. 27, 1989, now U.S. Pat. No. 5,058,611.

BACKGROUND OF THE INVENTION

1. Technical Field of the Invention

The present invention relates generally to a process and apparatus for the ultrasonic cleaning of a cylinder used in a printing press.

More particularly, the present invention provides for the ultrasonic cleaning of a printing cylinder employing rotational means for, preferably, the continuous rotation of a printing cylinder in a chamber while exposing such cylinder to sound waves having a frequency which, preferably, is in the range of 20–29 kHz for a period of time which would generally be less than 30 minutes. The means for rotation of the printing cylinder may be either magnetic or non-magnetic; the latter means being preferred. The ultrasonic cleaning of printing cylinders according to the present invention would preferably be carried out in a water-based chemical environment.

2. Description of the Prior Art

Heretofore, the removal of ink residues from engraved printing cylinders has always been a labor intensive activity which has often yielded less than acceptable results. Moreover, if the inks on the printing cylinders were not removed almost immediately from the cylinders and, instead, were allowed to dry, the cleaning of such cylinders became far more difficult, if not impossible. The complete removal of the inks was not always accomplished resulting in problems concerning the level of the quality of the print obtained when the cylinder was re-used.

In addition to the limited effectiveness of prior processes and means for cleaning printing cylinders, the typical inks which have been used by the printing industry have required a cleaning solution using a toxic, or otherwise flammable, organic solvent base. Such solvents have included, for example, acetone, methyl ethyl ketone and trichloroethane, as well as various alcohols. The health hazards to personnel working with such chemical cleaning solutions on a day-to-day basis, as well as problems of safe and legal waste disposal, are well known within the industry.

The recognized, and heretofore unfulfilled, need within the printing industry for alternative safe and effective means for the cleaning of printing cylinders has continuously grown more critical. During the past few years, safety and environmental concerns have become far more acute as the U.S. Environmental Protection Agency and OSHA, as well as various state and local agencies, have begun to strictly enforce laws and regulations governing the safe disposal and use of such potentially hazardous chemical agents.

By way of further background, one solution which has been attempted in order to overcome the foregoing health and safety concerns was the development of water-based inks as a replacement for the organically-based inks in use. Such water-based inks could, conceivably, be cleaned from the printing cylinders with cleaners having water-based solvents which could be handled and disposed of, along with the water-based inks used, in compliance with applicable health and safety requirements. When water-based inks were introduced, more and more printers began to switch to the use of such inks. This cured the problem of the safe and lawful disposal of the inks. However, it was soon realized that once the water-based inks dried on the printing cylinder and other parts of the printing presses used, they became extremely difficult to remove by conventional means.

In one sector of the trade, known as flexographic printing, the printing cylinder was coated with a ceramic. The ceramic would be coated onto the cylinder in a molten form via a process known as plasma coating. The desired printing pattern is then etched into the ceramic using a laser, with the ink cells created by the laser etching. These cells are often too small to be seen with the unaided eye. Laser etchings generally have a length, width and depth in the range of 10–40 microns. Thus, ink which had been dry within these cells became almost impossible to remove.

Cleaning methods, such as, high pressure water sprays, soaking and scrubbing with wire brushes, and the use of numerous harsh chemical agents, were all employed in various, less-than-satisfactory attempts to remove such inks. Labor costs were excessive and the result, in most cases, was a residue of dried ink in the cylinder cells causing an improper printing, and the need to shutdown the printing presses from time to time and adjust ink volumes or replace the entire printing cylinder with another. Large inventories of cylinders had to be retained in order to deal with this problem and, in many cases, printing cylinders thought to be defective were returned to suppliers for stripping, recoating and engraving at very high costs when, in actuality, such procedures were unnecessary; the printing cylinders were merely contaminated with ink trapped in the cells of the cylinders.

The use of ultrasonic energy as a procedure for cleaning a radiator having a header has been disclosed by Fields et. al. in U.S. Pat. No. 4,372,787, issued Feb. 8, 1983. Nevertheless, the potential benefits of using ultrasonic procedures in the unrelated art of cleaning printing cylinders, in order to overcome the drawbacks otherwise inherent when using organic- or water-based inks, as detained above, were never recognized by the printing industry. This was the fact that there was a widespread recognition that existing methods of effecting the cleaning of printing cylinders were time consuming, labor-intensive, not particularly effective, and often hazardous from a health and safety standpoint.

SUMMARY OF THE INVENTION

It is, therefore, an object of the present invention to provide a method and apparatus, employing ultrasonic energy to remove residual ink from the printing cylinders of printing presses.

It is, a further object of the present invention to provide a method and apparatus for the uniform cleaning of printing cylinders using ultrasonics which is less time consuming and more economical than currently employed procedures.

It is still a further object of the present invention to provide a method and apparatus for the uniform cleaning of printing cylinders using ultrasonics which is safe from both a health and environmental standpoint.

The foregoing and related objects are achieved by an apparatus which introduces ultrasonic waves into a tank having a cleaning liquid in which a printing cylinder to be cleaned can be immersed. The tank may be constructed out of a variety of materials depending, in part, upon the type of cleaning liquid employed. Such materials include, for example, stainless steel. The dimensions of the cleaning, or ultrasonics, tank to be used for the purpose of cleaning a printing cylinder are preferably 96" LR×10" FB×19" D and having a tank capacity of 70 gallons. It should, of course, be recognized that modifications of the foregoing dimensions are, of course, possible and should be considered within the scope of the present invention.

The apparatus of the invention would preferably include means for rotating, the printing cylinder in the tank. When the printing cylinder is rotated during introduction of the ultrasonic waves, a continuous and even cleaning of the cylinder from ink and other residue is achieved. The rotation may either be carried out via magnetic or non-magnetic rotational means. Testing has established that non-magnetic rotational means are more efficient and much preferred.

The ultrasonic waves used for cleaning should have a sufficient amplitude to cause microscopic voids, or "bubbles," to form throughout a cleaning liquid contained within a cleaning tank. The cleaning liquid is permeated with ultra-high frequency electrical energy, which is fed to a converter and changed into mechanical energy by, e.g., a lead-zirconate-titante transducer, piezoelectric-lzt-sandwich construction-type transducer, etc. A series of transducers are preferably mounted on the bottom of the cleaning tank. Subsequent compression portions within the ultrasonic waves cause the voids or bubbles produced by the waves as they collapse at high intensity levels, thereby creating shock waves which radiate from the nuclei of such voids. In ultrasonic cleaning, this phenomena, known as "cavitation," literally causes a ripping of contaminants from both the surface of the printing cylinder, as well as the most minute recesses of parts of the cylinder immersed in the cleaning liquid.

The ultrasonic cleaning of printing cylinders by way of the present invention is preferably carried out at a frequency range of greater than 20 kHz, preferably in the range of 25–29 kHz, most preferably at about 27 kHz, for between a period of time of 5–30 minutes. It should be recognized that a frequency which is too high will result in a poor cleaning, or excessively long cleaning times, whereas a frequency which is too low may result in cylinders which are only partially cleaned due to a pronounced "banding" of ultrasonic cavitation at the low end of the frequency range.

The ultrasonic cleaning of printing cylinders, according to the present invention, literally causes millions of cavitation bubbles to form and collapse at speeds of anywhere from 20 to 100,000 times per second. It should be recognized that although the engraved cells that hold the ink on the cylinder are themselves of microscopic size, i.e., having dimensions in the order of 10–40 microns, such cells are easily penetrated by cavitation and, thus, ink residues can be removed throughout the entire cells with greater effectiveness than would otherwise be possible with presently known, manual methods.

It has been determined that, in most cases, even when printing inks have been allowed to dry, that ultrasonic cleaning successfully and completely removes the dried ink residue within 30 minutes. Thus, chrome-plated gravure cylinders can generally be cleaned in ten minutes or less. In all such instances, no manual labor is required during the cleaning process other than the labor needed to activate the means necessary to place the printing cylinder into the cleaning tank, and later remove it following the cleaning process. By naming the ultrasonic cleaning of printing cylinders in accordance with the present invention, following a printing job, cylinders may be removed from the printing press, placed in a cleaning tank of the present invention, cleaned, usually, in under 30 minutes and immediately thereafter placed back on a printing press for use on a new job.

The cleaning solution employed in combination with the present invention should, preferably, be an alkaline aqueous-based solution, which is preferably biodegradable. Therefore the solution is capable of a safe and legal disposal so as to avoid the problems generally associated with non-aqueous based, or organic, cleaning solvents. The cleaning chemical may generally contain synthetic detergents, chelates and wetting agents, along with other additives which may perform other specific functions in the cleaning process.

The temperature of the cleaning solution during the ultrasonic cleaning of the printing cylinders should preferably be between 110°–160° F. depending, to some extent, upon the chemical composition of the cleaning agent. This is because it has been discovered that the cavitation levels during cleaning reach their optimum level within the foregoing temperature range. Temperatures in excess of 185° F., by contrast, generally result in a sharp reduction in the level of ultrasonic cavitation.

To ensure a proper ultrasonic cleaning of the printer cylinder within the ultrasonic tank, both the ultrasonic frequency, as briefly discussed above, and the power level within the cleaning tank are important. The ultrasonic power is, preferably, approximately 2400 watts; the frequency is preferably about 27 kHz.

As will be explained in greater detail with reference being made to the accompanying drawings, an adjustable pillow block is preferably used within the ultrasonic tank as a means for supporting the printing cylinder being cleaned. While being cleaned, the printing cylinder is preferably rotated continuously at a speed which is preferably, between 1–4 rpm.

Other objects and features of the present invention will become apparent and will be discussed below in combination with a description of the accompanying drawing figures. It should, of course, be recognized that the accompanying drawings are intended solely for purposes of illustration and are not intended as a means for defining the limits and scope of the present invention.

BRIEF DESCRIPTION OF THE DRAWINGS

In the drawings, wherein similar reference characters denote similar elements throughout the several views.

DESCRIPTION OF THE PREFERRED EMBODIMENTS

Figure 1:
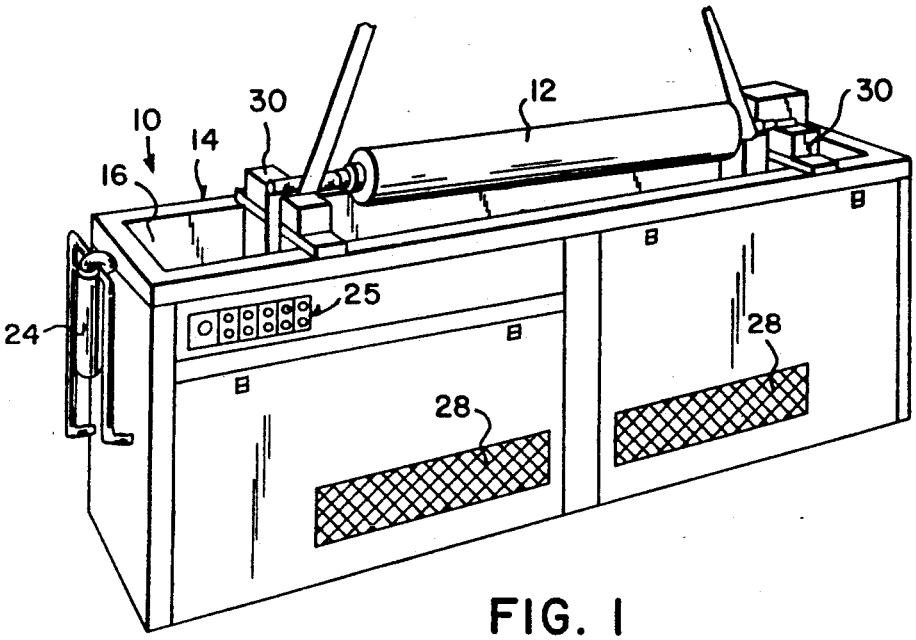
FIG. 1 is a perspective overview of the ultrasonic cleaning apparatus of the present invention with a printing cylinder shown atop the cleaning apparatus prior to its placement within said apparatus.

Referring to FIG. 1, there is shown a perspective view of a preferred embodiment of the ultrasonic cleaning apparatus 10 with a printing cylinder 12 being suspended above apparatus 10 prior to placement of cylinder 12 in the ultrasonic tank 14.

Ultrasonic cleaning tank 14 is preferably made of stainless steel, and preferably "300 series" stainless steel. Such a construction is preferred in order to prevent rust and chemical corrosion. Tank 14 is preferably constructed so that its walls 16, which define the length of tank 14, are maintained at a distance of from two inches to four inches from the face of cylinder 12 in order to focus maximum ultrasonic power against the face of the cylinder. It has been discovered during testing that, although cylinders 12 may be cleaned using greater distances between walls 16 of tank 14 and the face of the printing cylinder, the time period necessary for cleaning the cylinder is increased, thereby causing a loss of efficiency in the cleaning process.

This also holds true if the distance of the surface of the printing cylinder is increased from the radiating source of the ultrasonic waves. The distance between the ultrasonic energy source and the surface of the printing cylinder should, preferably, be maintained at from three to five inches. If the distance between the radiating energy source and the printing cylinder surface is not maintained within this range, particularly if it is greater than five inches, it has been discovered that the time cycle necessary for performing the cleaning is adversely affected due to a loss of ultrasonic energy. Additionally, a distance of less than three inches between the source of the ultrasonic energy and the face of the printing cylinder being cleaned would, adversely, cause ultrasonic radiation to reflect back to the transducers, which initially act to radiate the sound waves into the cleaning liquid. This "reflecting back" of ultrasonic radiation to the transducers of the apparatus can cause electrical spiking to occur in the generator circuits, severely etch the radiating surface, and tend to trap the ultrasonic radiation within the narrow distance between the source of the radiation and the printing cylinder surface thereby reducing the overall efficiency of the cleaning procedure throughout the remainder of the cleaning tank.

Figure 2:
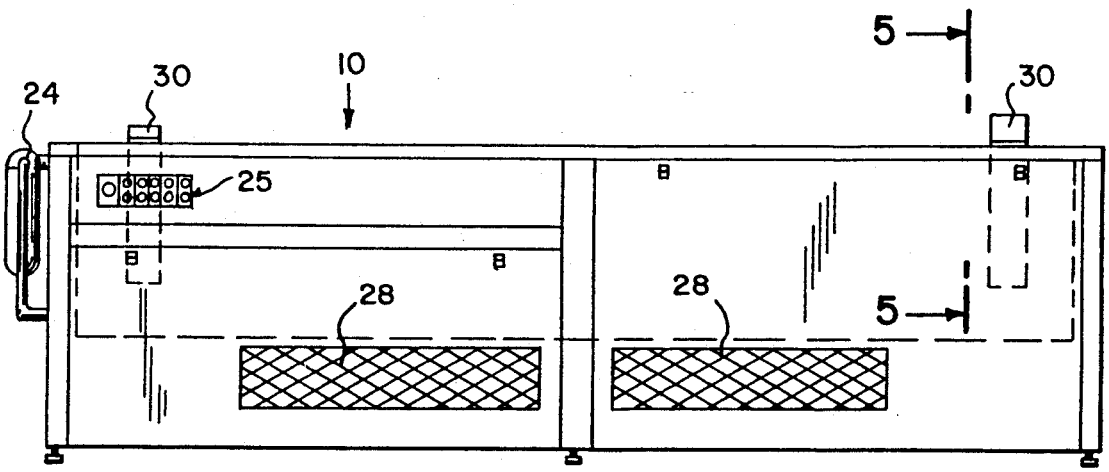
FIG. 2 is a side view, in elevation, of the ultrasonic cleaning apparatus of FIG. 1.
Figure 3:
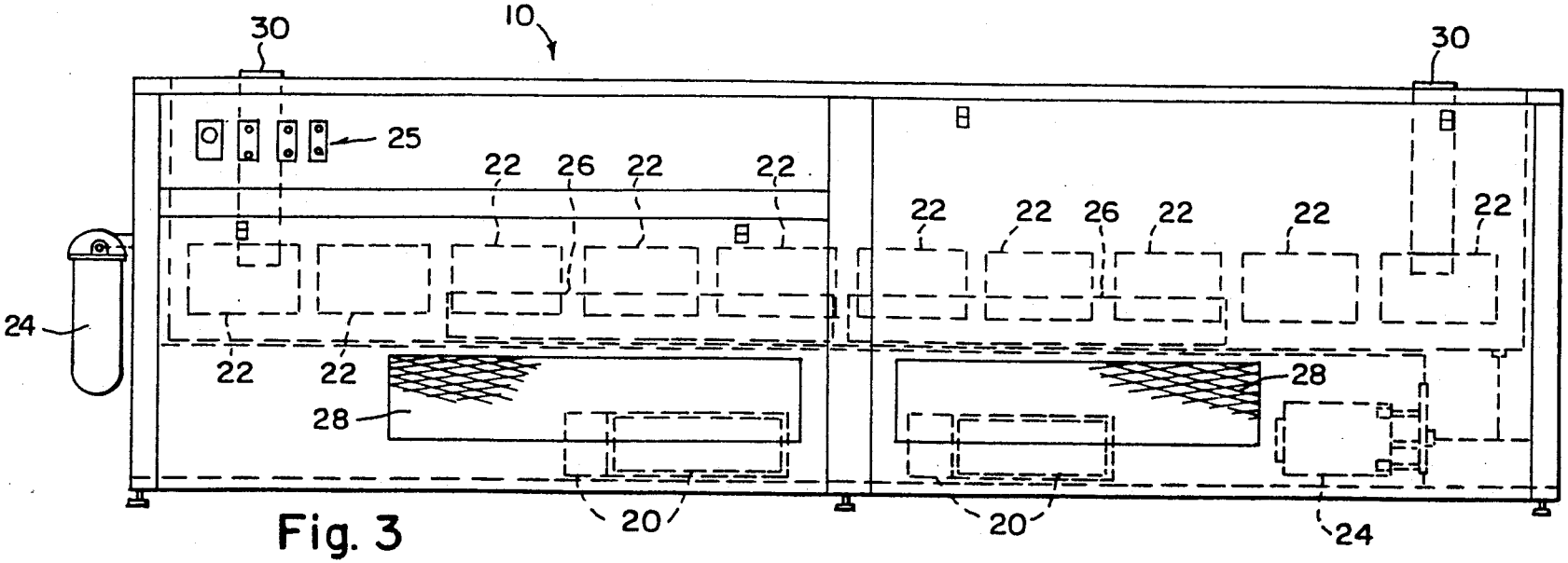
FIG. 3 is a detailed side view, in elevation, of a preferred embodiment of the cleaning apparatus of FIG. 2.
Figure 4:
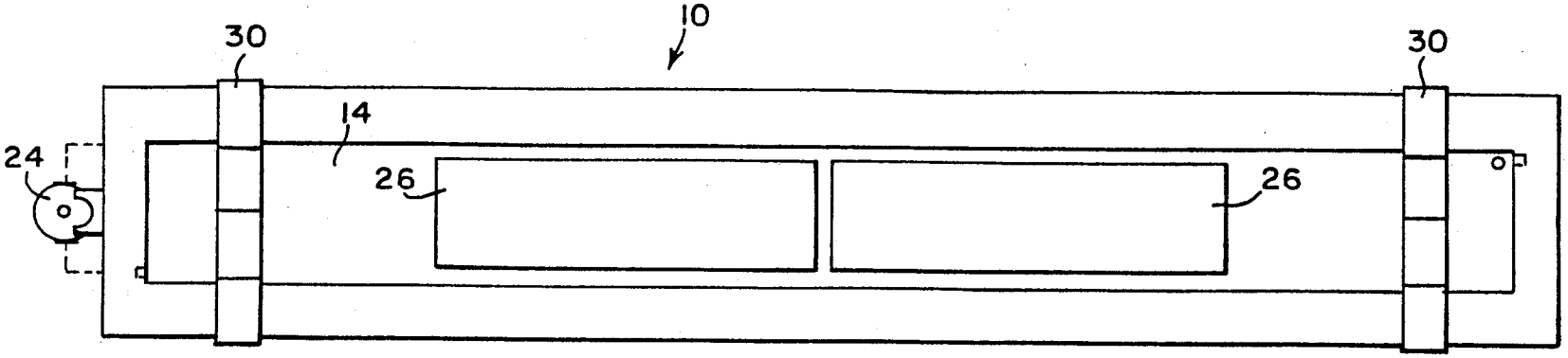
FIG. 4 is a top view of the preferred embodiment of the cleaning apparatus of FIG. 2; and, FIG. 5 is an elevational view, taken along line 5—5 of FIG. 2, of a preferred means for rotation of a printing cylinder during an ultrasonic cleaning within the cleaning apparatus of the invention.

FIGS. 2 and 3 present side views of a preferred embodiment of cleaning apparatus 10 of the present invention, with FIG. 3 showing, in phantom, the internal features of the apparatus. Apparatus 10 includes one or more ultrasonic wave radiating units or transducers 26, which are preferably designed to be immersible within tank 14. Ultrasonic radiating units 26 are preferably mounted either in the bottom of tank 14, on one side wall, or on both side walls 16 of the tank. Radiating units 26 are preferably designed so that their lengths are approximately equal to the length of the surface of a conventional printing cylinder 12, which is to eventually be cleaned in apparatus 10. The journals, or shafts, at either end of conventional printing cylinders do not ordinarily require cleaning and, in any event, are not difficult to clean via conventional means when desirable.

Testing has indicated that ultrasonic wave frequencies should generally be at least 20 kHz, preferably between 25–29 kHz, and most preferably, approximately 27 kHz, through frequencies as great as 40 kHz may also be utilized. Experience has shown that the lower the frequency of the ultrasonic waves, the more intense the ultrasonic waves are to produce intense cavitation, which speeds along the cleaning process. Higher frequencies, such as those of 40 kHz, or greater, have a tendency to produce less intense cavitation. If the cavitation is less intense it will take a greater period of time to perform the cleaning function. While the difference in cleaning times would generally be only a matter of a few minutes, when a large volume of cleaning is required, the distinction in cleaning time may become significant.

Power outputs 20 to ultrasonic wave radiating units 26, were found to be most effective when they produced a power output level of approximately 5–6 watts per square inch of immersible irradiating surface. Power levels lower than this preferred range were found to increase the cleaning time unnecessarily, while higher power levels were found to increase the cost of operating the apparatus. Moreover, power levels which are too high can cause a cavitation barrier to form on the ultrasonic radiating surface. Severe erosion of the irradiating surface could also occur at power levels which are too high, along with the possibility that the print cylinders could be damaged, including a chrome plating over copper or other types of metallic bases.

As previously alluded to, the immersed ultrasonic wave generating units 26 are, preferably designed so that the width of the irradiating surface of such units is substantially equal to the diameter of the surface of the printing cylinder to be cleaned. The length of the irradiating surface of the ultrasonic wave generating units 26 is, preferably, substantially equal to, or greater than, the length of the cylinder surface. This preferred construction is designed to create a focused type of ultrasonic field which provides intense and evenly distributed cavitation against the cylinder surface of printing cylinder 12 as the printing cylinder is preferably rotated in the ultrasonic field, within the cleaning tank.

Based upon the preferred design of the irradiating surfaces of the ultrasonic wave generating units, and the preferred output level of power, it is projected that the total ultrasonic power of apparatus 10 would be approximately 2400 watts.

Referring, further, to FIG. 3, tank 14 is equipped with one or more heating units 22 in order to maintain the cleaning solution (which is to be discussed in further detail hereinafter) at a temperature which is effective for carrying out the ultrasonic cleaning procedure. The heating units are, preferably, 8-kilowatt units and controlled via a thermostat. The temperature of the cleaning solution should preferably be maintained within the range of 110°–160° F., depending upon the type of cleaning solution employed, and should generally not exceed 185° F. The proper temperature for the cleaning solution is important, both with respect to the effectiveness of the chemical cleaning solution employed and, additionally, with respect to maximizing the production of ultrasonic cavitation.

As an option, tank 14 is further provided with a filtering system 24, which includes a means for recirculating the cleaning solution employed in tank 14, in order to remove particulate matter from the cleaning solution and thereby prolong its effectiveness, as well as to prevent excessive contamination from a reducing formation of ultrasonic cavitation. The filter should, preferably have pores sized between 5–50 microns, most preferably about 20 microns.

Tank 14 is also preferably equipped with a drain and inlet water fittings (not shown) for ease of use. The tank solution may either be gravity drained or pumped from cleaning tank 14. Water may also be pumped into the unit to facilitate the filling of the cleaning tank. An overflow outlet is also, preferably, provided in order to prevent an accidental spill due to the overfilling of the cleaning tank. In a preferred embodiment of the invention, it is further recommended that a conventional low level liquid sensor be installed as a means for preventing damage to the ultrasonic wave radiating units 26, immersed in the cleaning solution, and the heating units 22, should the cleaning liquid level drop below a predetermined level.

Control of low level sensors, as well as thermostatic means for regulating the temperature of the cleaning solution within tank 14, and means for regulation of the time of the ultrasonic cleaning procedure may be carried out via conventional controls, designated by reference numeral 25.

FIG. 3 further shows, in phantom, the location of transducers 26 for radiation of the ultrasonic sound wave into the cleaning liquid within tank 14. Transducers 26 preferably have a piezoelectric-lzt-sandwich construction, though, clearly, it should be understood that a wide variety of transducers may be employed in combination with the inventive apparatus. In the preferred embodiment illustrated in the drawing figures, reference numeral 28 refers to heat exhaust means of apparatus 10.

The chemical cleaning solution employed in the ultrasonic cleaning process of the present invention is, preferably, a biodegradable alkaline detergent solution, which, more particularly, is preferably composed of alkaline phosphates, wetting agents and amines (e.g., 5–10%, by volume, mono-ethanol amine) in a water base. One such cleaning solution is sold under the trademark "#116 SONICOR SONIC-STRIP" and is commercially available from Sonicor Instrument Corporation, 100 Wartburg Avenue, Copiague, N.Y. 11726, U.S.A. The chemical cleaning agent employed should be capable of dissolving, or otherwise breaking up oils, grease, light carbon, as well as many other organic and inorganic contaminants when combined with ultrasonic cavitation.

Apparatus 10 preferably includes positioning fixture 30, with a feeder mechanism, which acts as a means for guiding printing cylinder 12 into tank 14 when the user wishes to clean a printer cylinder. Positioning fixture 30 is preferably made of stainless steel and has a "V"-block arrangement. Once the printing cylinder is within the cleaning tank of the apparatus, in order to clean the cylinder quickly and evenly over the entire print face, printing cylinder 12 should be rotated through the cavitation field within the cleaning solution created by the radiating ultrasonic waves.

Testing done in the early phases of designing the invention indicated that printing cylinders continually rotating through the ultrasonic radiation field, via non-manual means, were cleaned evenly and consistently in approximately 20–30 minutes.

By contrast, cylinders which were not continually rotated through the cavitation field, but rather, were periodically rotated manually, approximately every five minutes, were not evenly cleaned and generally took as much as 20 minutes longer to clean completely. Even in such case, some streaking was evident on the cylinders' printing surfaces. Cylinders rotated manually with only a part of the cylinder immersed in the cleaning tank were never completely cleaned since the surfaces of such cylinders tended to flash dry as the hot cleaning solution dried on the surface as the cylinder rotated, partially, outside of the liquid.

Figure 5:
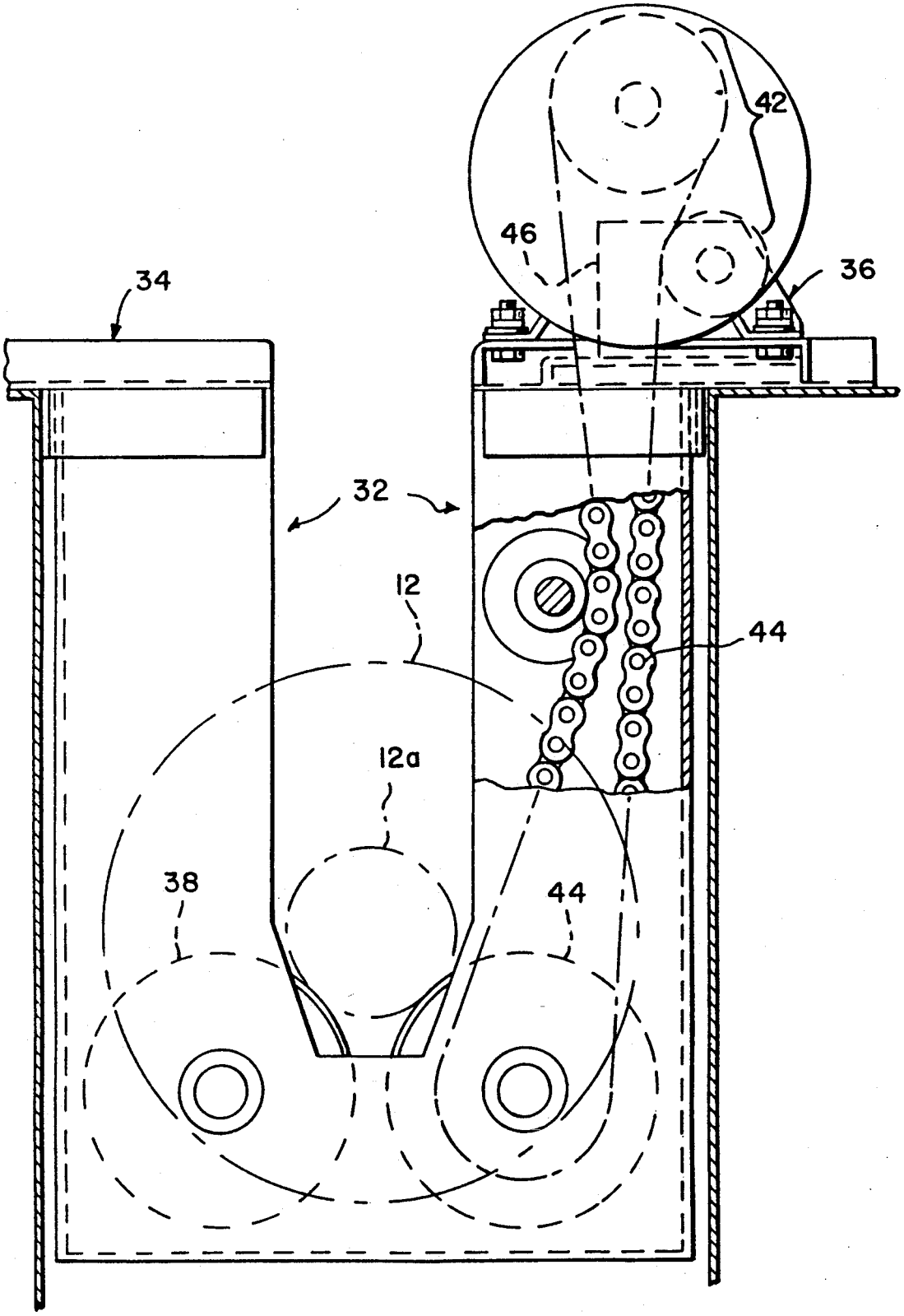

A preferred rotation system which may be used in combination with the present invention is shown, in cross-section, in FIG. 5. The rotation means 32 preferably rests, unattached, on top of apparatus 10, has a stainless steel frame, and includes a drive end and an idler. More particularly, rotation means 32, as illustrated in FIG. 5, includes two fixtures 34, 36.

One fixture (34) is simply an idler fixture, having, preferably, a stainless steel frame, and two free spinning wheels 38 (one free spinning wheel being visible in the cross-sectional view presented), preferably made of polyurethane, upon which the shaft **12*a* of printing cylinder 12 is to rest within cleaning tank 14**.

Rotation means 32, opposite idler fixture 34, includes a drive fixture 36, preferably having a stainless steel frame with two wheels 40 (one visible in the cross-sectional view of FIG. 5), preferably made of polyurethane. Wheels 40, like wheels 38, also support shaft **12*a* of printing cylinder 12, however, wheels 40 include a gear sprocket arrangement 42 and a drive chain 44 driven by an electric motor 46. The sprocket gear arrangement is preferably made of stainless steel, though other materials, such as polyurethane, may be used for this purpose. Upon operation, the electric motor activates gear sprocket arrangement 42 to move drive chain 44, which rotates wheels 40, which, in turn, causes rotation of shaft 12*a* of printing cylinder 12**.

The printing cylinder should preferably be rotated through the generated ultrasonic wave field at a rotation rate of between 1–4 rpm. Testing has shown these rotation rates to be very effective. A slower rotation speed required, unnecessarily, a greater length of time to effect proper cleaning of the printing cylinder, while a faster rotational velocity did not effectively remove contaminants from the bottom of the ink cells in the face of the printing cylinder.

In designing and testing the apparatus of the invention, the rotation system was initially designed to rotate the cylinder on a roller bearing which rotated it in the printing press. The printing cylinder was turned quite easily as a flexible shaft was attached to one end of the printing cylinder shaft with a large magnet, while the opposite end of the cylinder shaft was driven by an electric motor. The system was cumbersome and worked to eventually clean the printing cylinder, although it had numerous problems. There were many shaft configurations which did not lend themselves to attachment of the magnetic means. In addition, different lengths of different cylinders required a changing of the length of the flexible shaft which, on occasion, would malfunction from too sharp of a bend radius and, would sometimes, come loose during rotation. This required the operator of the ultrasonic cleaning apparatus to attempt to reattach the magnet to the shaft. Since the shaft was not normally visible when submersed within the cleaning liquid, considerable dexterity and caution was necessary since the liquid temperature of the cleaning liquid was, generally, about 140° F.

The rotation means illustrated in FIG. 5, is non-magnetic, and has been found to overcome many of the drawbacks experienced by the flexible shaft/magnetic rotation means, described immediately above. Both the preferred non-magnetic rotation means, and the magnetic means, however, have been found to be effective, albeit to varying degrees, in the apparatus of the present invention and it should be understood that both are encompassed within the scope of the present invention.

While several embodiments of the present invention have been shown and described, it should be recognized that many modifications may be made to the present invention by those persons skilled in the art, without departing from the spirit and scope thereof.

What is claimed is:

1. A process for cleaning a print cylinder with a liquid cleaning solution within a cleaning tank, comprising the steps of:

submersing the printing cylinder to be cleaned in the liquid cleaning solution contained with the cleaning tank, said printing cylinder having a print face and to prevent damage to said print face;

heating the liquid cleaning solution to a temperature below 185° F.;

radiating ultrasonic waves at frequency of 20 kHz to 40 kHz from a generating means into the liquid cleaning solution;

maintaining said means for generating the ultrasonic waves at a distance of three to five inches from the print face of the printing cylinder in order to clean the cylinder quickly and evenly over the entire print face and to prevent damage to said print face; and removing the printing cylinder from the liquid cleaning solution once the printing cylinder is clean.

2. The process for cleaning a printing cylinder according to claim 1, wherein the printing cylinder is fully submersed in the liquid cleaning solution.

3. The process for cleaning a printing cylinder according to claim 1, wherein the liquid cleaning solution is heating during said heating step to a temperature between 130°–160° F. and maintained at such temperature during the cleaning process.

4. The process for cleaning a printing cylinder according to claim 1, wherein the ultrasonic waves radiated into the liquid cleaning solution during said radiating step have an ultrasonic frequency between 25–29 kHz.

5. The process for cleaning a printing cylinder according to claim 4, wherein the ultrasonic frequency is approximately 27 kHz.

6. The process for cleaning a printing cylinder according to claim 1, wherein the printing cylinder being cleaned is rotated during said radiating step.

7. The process for cleaning a printing cylinder according to claim 6, wherein the printing cylinder is rotated at between 1–4 rpm during said radiating step.

8. The process for cleaning a printing cylinder according to claim 6, wherein the printing cylinder is rotated via non-magnetic means.

9. The process for cleaning a printing cylinder according to claim 1, wherein said radiating of the ultrasonic waves is carried out for between 5–30 minutes.

10. The process for cleaning a printing cylinder according to claim 1, wherein the liquid cleaning solution is an alkaline aqueous-based solution.

11. The process for cleaning a printing cylinder according to claim 10, wherein the alkaline aqueous-based solution is biodegradable.

12. The process for cleaning a printing cylinder according to claim 1, wherein said means for generating the ultrasonic waves is a transducer for radiation of the ultrasonic sound waves.

13. The process for cleaning a printing cylinder according to claim 1, further comprising filtering the cleaning liquid contained within said cleaning tank during cleaning of the printing cylinder.

14. The process for cleaning a printing cylinder according to claim 1, further comprising sensing a low level of liquid within said cleaning tank for terminating the cleaning of the printing cylinder when the level of the cleaning liquid falls below a pre-determined level within said cleaning tank.

15. The process for cleaning a printing cylinder according to claim 1, wherein the printing cylinder is completely submersed in the liquid cleaning solution.

* * * * *

UNITED STATES PATENT AND TRADEMARK OFFICE

CERTIFICATE OF CORRECTION

PATENT NO. : 5,240,506

DATED : August 31, 1993

INVENTOR(S) : Arthur H. Liers, et al

It is certified that error appears in the above-indentified patent and that said Letters Patent is hereby corrected as shown below:

Column 9, line 11, delete "print" and insert --printing;
line 15, delete "with" and insert --within--;
line 17, delete in its entirety and insert a semicolon--;--.

Signed and Sealed this

Tenth Day of May, 1994

Bruce Lehman

*Attest:*

BRUCE LEHMAN

*Attesting Officer*

*Commissioner of Patents and Trademarks*